US007128871B2

(12) United States Patent
Davitz

(10) Patent No.: US 7,128,871 B2
(45) Date of Patent: Oct. 31, 2006

(54) SILVER-COLORED ALLOY WITH LOW PERCENTAGES OF COPPER AND ZINC

(75) Inventor: Daniel Davitz, Glenview, IL (US)

(73) Assignee: Sterilite LLC, Carson, CA (US)

( * ) Notice: Subject to any disclaimer, the term of this patent is extended or adjusted under 35 U.S.C. 154(b) by 0 days.

(21) Appl. No.: 10/786,974

(22) Filed: Feb. 25, 2004

(65) Prior Publication Data

US 2005/0186107 A1 Aug. 25, 2005

(51) Int. Cl.
*C22C 5/08* (2006.01)

(52) U.S. Cl. ..... 420/504; 420/502

(58) Field of Classification Search ..... 420/504, 420/502, 506

See application file for complete search history.

(56) References Cited

U.S. PATENT DOCUMENTS 4,973,446 A 11/1990 Bernhard et al.
5,037,708 A 8/1991 Davitz
5,039,479 A 8/1991 Bernhard et al.
5,817,195 A * 10/1998 Davitz ..... 148/430
5,882,441 A * 3/1999 Davitz ..... 148/430
6,726,877 B1 * 4/2004 Eccles ..... 420/504

OTHER PUBLICATIONS

Harada Takeshi, Electrical Contact Material, Abstract of Japanese Patent No. JP59038346, Mar. 2, 1984.
Kasai Toshiro et al., Sulfidization-Resisting Silver Alloy, Abstract of Japanese Patent No. JP62243725, Oct. 24, 1987.

* cited by examiner

*Primary Examiner*—George Wyszomiersk
*Assistant Examiner*—Janelle Morillo
(74) *Attorney, Agent, or Firm*—Vedder Price Kaufman & Kammholz

(57) ABSTRACT

A silver-colored, tarnish-resistant, corrosion-resistant alloy is provided. The alloy includes 92.5–95% silver, combined with a master alloy of 24–34% zinc; 60–74% copper; 0.5–1.8% silicon; 0.0–8.0% tin, or 0.0–1.5% indium, wherein percentages are in terms of weight. The alloy can be used for jewelry items, tableware items, dental items or other items that should resist tarnishing or corrosion and which require a non-brittle alloy.

16 Claims, No Drawings

SILVER-COLORED ALLOY WITH LOW PERCENTAGES OF COPPER AND ZINC

FIELD OF THE INVENTION

The invention relates generally to alloys, and specifically to alloys having improved tarnish resistance and casting qualities to make jewelry, dental fillings and utensils.

BACKGROUND OF THE INVENTION

Sterling silver jewelry and utensils are valued because of their intrinsic worth and the silver color of the metal. The alloys from which sterling silver jewelry and utensils are made are preferably moldable and castable, yet hard enough for sterling silver jewelry. One problem with sterling silver is its tendency to tarnish. Another problem with sterling silver is the fact that sterling silver is usually brittle after casting. Sterling silver alloy is generally 92.5% silver and 7.5% copper, and many attempts have been made to improve the tarnish resistance and corrosion resistance of sterling silver and to improve the casting qualities of the alloy by the addition of other metals.

For example, alloys known as precium have been produced with approximately 74% silver, 25% PD and 1% IN. However, precium alloys have been found to be too expensive for substantial commercial use. A prior art, tarnish-resistant and corrosion-resistant silver-colored alloy is disclosed in U.S. Pat. No. 5,037,708, entitled "Silver Palladium Alloy." The alloy in this prior art patent is made up of 80% to 92.5% silver, 4% to 9% palladium, 10% to 0% copper and 1% to 0.5% indium or zinc. U.S. Pat. No. 4,944,985 to Alexander discloses a silver alloy for plating that uses silica as an extender, but does not use pure metal silicate as in the present invention or for improved casting properties. Rather, silicate in combination with other materials is disclosed. Alexander et al. further discloses that ductility and smooth surface finish are desirable, but does not describe how to prevent brittleness. Further, Alexander et al. describes the use of silicates as extenders, which are defined as making casting easier and increasing the volume of the alloy using low-cost materials.

Japanese Patent No. 59038-346A teaches an alloy that has zinc and nickel. This prior art reference also uses indium and bismuth. While these prior alloys are useful, a sterling silver alloy that is less expensive would be an improvement over the prior.

Japanese Patent No. 62-243725 teaches a jewelry alloy with concentrations of silver, zinc, indium, and copper; however, its casting properties and melting are not well-suited for jewelry.

SUMMARY OF THE INVENTION

A first alloy of zinc, copper, silicon, and tin or indium, (or both) is added to silver and provides a second resultant alloy, i.e., a silver alloy that is hard, and which has a high tarnish resistance. In a 5% chlorine atmosphere, the resultant silver alloy has tarnish resistance that is superior to prior art sterling silver containing 92.5% by weight silver and 7.5% by weight copper, and shows no perceptible discoloration while the sterling silver tarnished. The silver alloy of zinc, copper, silicon, tin and silver is also more corrosion-resistant than sterling silver. A small amount of copper provides hardness. A small amount of tin with silicon increases corrosion resistance and provides better working properties by reducing brittleness. The resultant alloy has improved corrosion resistance and improved tarnish resistance at a relatively low cost.

All percentages referred to following the description are percents by weight, based on the total weight of material or mixture.

DETAILED DESCRIPTION OF THE PREFERRED EMBODIMENTS

The preferred embodiment of a silver-colored alloy is created by placing an amount of silver substrate in a crucible that is made of graphite, ceramic or other appropriate material. An alloy made up of zinc, copper, silicon and tin, in amounts described below and which is referred to herein as "Sterilite," is added to the silver in the crucible. The silver and the Sterilite alloy are then heated to 1,850 degrees F., +/−50 so that the Sterilite alloy and silver are mixed. The molten crucible contents are then mixed, in an oxygen-free environment, which is preferably provided by heating the crucible and its contents in an argon atmosphere, or under a vacuum. The use of the argon keeps oxygen from the additive alloy and permits proper integration of the zinc into the alloy.

To be considered in the sterling silver "family," a silver alloy should have approximately 92.5 percent by weight silver, the remainder of which should be copper. Unlike the prior art silver/copper mixture, the preferred embodiment of a silver alloy is comprised essentially of 92.5%–95% silver. An alloy is added to the silver which, in the preferred embodiment is made up of zinc, copper, silicon and tin. A first alternate embodiment of the alloy added to the silver has no tin, while a second alternate embodiment has about 1.2% tin and about 0.90% indium.

Tarnish resistance is enhanced by using zinc and silicon. In addition to improved tarnish and corrosion resistance, zinc also provides a more stable color for the alloy than conventional sterling silver, and reduces the brittleness of conventional sterling silver alloy after casting. Silicon acts as a de-oxidizer to prevent tarnish. The copper and tin or indium act as hardeners.

At least three different "Sterilite" alloy formulas are set forth in the following table.

Preferred Sterilite Formulas

| ALLOY | #240 | #250 | #270 |
|---|---|---|---|
| Designation | | | |
| Zinc | 24.0% | 29.75% | 32.60% |
| Copper | 74.8% | 62.15% | 64.70% |
| Silicon | 1.2% | 01.35% | 00.60% |
| Tin | 0 | 06.75% | 01.20% |
| Indium | 0 | 0% | 0.90% |
| Total | 100% | 100% | 100.0% |

The preferred alloy is formula #250 in the foregoing table. Its composition is 29.75% zinc, 62.15% copper, 1.35% silicon and 6.75% tin. Composition #240 in the table is at least one alternate embodiment. This first alternate embodiment is made up of 24.0% zinc, 74.8% copper and 1.2% silicon. Alloy #270 is considered a third alternate embodiment. It is made up of 32.60% zinc, 64.70% copper, 0.60% silicon, 0.90% tin and 1.20% indium. The Sterilite alloy components can each be varied up to approximately five percent (±5%) of their weight without significantly degrading the tarnish resistance or the corrosion resistance of an alloy formed by silver and the Sterilite alloy. In general, the constituents of the Sterilite alloy added to silver can have the following ranges: 24–34% zinc; 60–74% copper; 0.5–1.8% silicon; 0.0–8.0% tin; 0.0–1.5% indium.

The five percent tolerance on component amounts is illustrated by way of example. For instance, 100 grams of formula #240 could be made from 24.8 grams of zinc, ±1.24 grams (i.e., ±5% of 24.8 grams), so long as amounts of the other components of the formula are adjusted to account for an increased or decreased amount of zinc. To produce exactly 100 grams of formula #240, varying the amount of zinc by ±1.24 grams will require an equal amount of one or more of the other components of formula #240 (copper and silicon) to be increased and/or decreased by the amount by which the zinc varies. If the amount of zinc to make 100 grams of formula #240 is increased by 1.24 grams (i.e., ±5% of 24.8 grams), the amount of copper and/or silicon would need to be decreased by a corresponding amount, i.e., a total of 1.24 grams. One way to accommodate 1.24 additional grams of zinc would be to reduce only the copper by 1.24 grams. Alternatively, the copper and silicon could both be reduced by a total of 1.24 grams. Stated alternatively, of 100 grams of formula #240, 24.8 grams, ±1.24 grams are zinc (24.8 grams ±5% of 24.8); 74.8 grams ±3.74 grams are copper (i.e., ±5% of 74.8 grams); and 1.2 grams ±0.06 grams are silicon (i.e., ±5% of 1.2 grams).

Alloying Process

A preferred method of forming the alloys is set forth hereinafter. Alloy #250 in the foregoing table melts at approximately 875° C./1610° F. The alloy is considered "pasty" around 850° C./1562° F. The alloying temperature is considered to be 1010° C./1850° F. The alloy's graining temperature is 980° C./1796° F.

First, layer the melt by making a bed of approximately ⅓ fine silver in a crucible followed by the addition of Sterilite alloy, the component portions of which are described above. A small of amount of flux, which is formed by combining Borax and Boric Acid, can be added on the Sterilite. The remaining ⅔ of Silver is added on top of the Sterilite. The mixture is then heated to 1010° C. (1850° F.).

Between the melting point temperature of 875° C. (1605° F.) and the alloying temperature of 1010° C. (1850° F.), "pulse" the melted mixture using a Neutec or stir the melted mixture if you have a machine that is "melt-accessible".

Hold the mixture temperature at 1010° C. (1850° F.) for 30 seconds, then discontinue heating. Allow the melt to cool to 850° C. (1562° F.). Reheat the mixture to 980° C. (1796° F.), after which the molten mixture can be poured into an appropriate mold.

Residue can be scraped from the crucible into a slag catcher. The residue is a by-product of the alloying process and is an oxide given off during the melt. It is harmlessly scraped away when the melt is finished.

Those of skill in the jewelry art appreciate that wearers of silver-colored jewelry (e.g., rings, earrings, watchbands, bracelets, necklaces and even medical alerts) and users of dental filler prefer alloys that do not tarnish or discolor. Similarly, users of prior art sterling silver tableware prefer metal tableware items (e.g., knives, forks, spoons and serving pieces, bowls, platters, etc.) that do not tarnish or discolor. By adding the Sterilite alloys described herein, a silver-color alloy, having a more ornamental finish than is possible with stainless steel, can be realized, one that is tarnish- and corrosion-resistant, yet less costly to produce than prior art alloys. Jewelry, tableware, dental fillings and dental molding can be made more tarnish-resistant and more corrosion-resistant at a lower cost.

What is claimed is:

1. A silver-colored, tarnish-resistant, corrosion-resistant alloy consisting essentially of:
- 92.5 to 95% by weight silver, the balance of which is an alloy consisting essentially of:
  - approximately 24–34% by weight zinc;
  - approximately 60–74% by weight copper;
  - approximately 0.5–1.8% by weight silicon; and
  - approximately 0–8% by weight tin;
  - wherein hardening agents consist of tin and copper.

2. A silver-colored, tarnish-resistant, corrosion-resistant alloy consisting essentially of:
- 92.5 to 95% by weight silver, the balance of which is an alloy consisting essentially of:
  - approximately 24%±1.2% by weight zinc;
  - approximately 74.8%±3.74% by weight copper; and
  - approximately 1.2%±0.06% by weight silicon; and
  - wherein hardening agent consists of copper.

3. A silver-colored, tarnish-resistant, corrosion-resistant alloy consisting essentially of:
- 92.5 to 95% by weight silver, the balance of which is an alloy consisting essentially of:
  - approximately 32.6%±1.63% by weight zinc;
  - approximately 61.5–67.9% by weight copper;
  - approximately 0.6%±0.03% by weight silicon;
  - approximately 1.2%±0.06% by weight tin;
  - approximately 0.9%±0.05% by weight indium;
  - wherein hardening agents consist of tin, indium, and copper.

4. A silver-colored, tarnish-resistant, corrosion-resistant alloy consisting essentially of:
- 92.5 to 95% by weight silver, the balance of which is an alloy consisting essentially of:
  - approximately 29.75% by weight zinc;
  - approximately 62.15% by weight copper;
  - approximately 1.35% by weight silicon;
  - approximately 6.75% by weight tin;
  - wherein hardening agents consist of copper and tin.

5. A silver-colored, tarnish-resistant, corrosion-resistant jewelry consisting essentially of:
- 92.5 to 95% by weight silver, the balance of which is an alloy consisting essentially of:
  - approximately 24.0% by weight zinc;
  - approximately 74.8% by weight copper; and
  - approximately 1.2% by weight silicon; and
  - wherein hardening agent consists of copper.

6. A silver-colored, tarnish-resistant, corrosion-resistant jewelry consisting essentially of:
- 92.5 to 95% by weight silver, the balance of which is an alloy consisting essentially of:
  - approximately 32.6% by weight zinc;
  - approximately 64.7% by weight copper;
  - approximately 0.6% by weight silicon;
  - approximately 0.9% by weight tin; and
  - approximately 1.2% by weight indium;
  - wherein hardening agents consist of copper, tin, and indium.

7. A silver-colored, tarnish-resistant, corrosion-resistant jewelry consisting essentially of:
- 92.5 to 95% by weight silver, the balance of which is an alloy consisting essentially of:
  - 29.75% by weight zinc;

62.15% by weight copper;
1.35% by weight silicon; and
6.75% by weight tin:
wherein hardening agents consist of tin and copper.

8. A silver-colored, tarnish-resistant, corrosion-resistant jewelry consisting essentially of:
92.5 to 95% by weight silver, the balance of which is an alloy consisting essentially of:
32.60% by weight zinc;
64.70% by weight copper;
0.60% by weight silicon;
0.90% by weight tin; and
1.20% by weight indium;
wherein hardening agents consist of copper, tin, and indium copper.

9. A silver-colored, tarnish-resistant, corrosion-resistant alloy consisting essentially of:
92.5 to 95% by weight silver, the balance of which is an alloy consisting essentially of:
approximately 24–34% by weight zinc;
approximately 60–74% by weight copper;
approximately 0.5–1.8% by weight silicon;
wherein hardening agent consists of copper.

10. A silver-colored, tarnish-resistant, corrosion-resistant alloy consisting essentially of:
92.5 to 95% by weight silver, the balance of which is an alloy consisting essentially of:
approximately 24–34% by weight zinc;
approximately 60–74% by weight copper;
approximately 0.5–1.8% by weight silicon;
approximately 0.9%±0.05% by weight indium;
wherein hardening agents consist of copper and indium.

11. A silver-colored, tarnish-resistant, corrosion-resistant alloy consisting essentially of:
92.5 to 95% by weight silver, the balance of which is an alloy consisting essentially of:
approximately 24%±1.2% by weight zinc;
approximately 1.2%±0.06% by weight silicon; and
approximately 74.8%±3.74% by weight copper;
wherein hardening agent consists of copper.

12. A silver-colored, tarnish-resistant, corrosion-resistant alloy consisting essentially of:
92.5 to 95% by weight silver, the balance of which is an alloy consisting essentially of:
approximately 24%±1.2% by weight zinc;
approximately 1.2%±0.06% by weight silicon;
approximately 74.8%±3.74% by weight copper; and
approximately 1.2%±0.06% by weight tin;
wherein hardening agents consist of copper and tin.

13. A silver-colored, tarnish-resistant, corrosion-resistant alloy consisting essentially of:
92.5 to 95% by weight silver, the balance of which is an alloy consisting essentially of:
approximately 24%±1.2% by weight zinc;
approximately 1.2%±0.06% by weight silicon;
approximately 74.8%±3.74% by weight copper; and
approximately 0.9%±0.05% by weight indium;
wherein hardening agents consist of copper and indium.

14. A silver-colored, tarnish-resistant, corrosion-resistant alloy consisting essentially of:
92.5 to 95% by weight silver, the balance of which is an alloy consisting essentially of:
approximately 32.6%±1.63% by weight zinc;
approximately 0.6%±0.03% by weight silicon; and
approximately 64.7%±3.24% by weight copper;
wherein hardening agent consists of copper.

15. A silver-colored, tarnish-resistant, corrosion-resistant alloy consisting essentially of:
92.5 to 95% by weight silver, the balance of which is an alloy consisting essentially of:
approximately 32.6%±1.63% by weight zinc;
approximately 0.6%±0.03% by weight silicon; and
approximately 64.7%±3.24% by weight copper;
approximately 1.2%±0.06% by weight tin;
wherein hardening agents consist of copper and tin.

16. A silver-colored, tarnish-resistant, corrosion-resistant alloy consisting essentially of:
92.5 to 95% by weight silver, the balance of which is an alloy consisting essentially of:
approximately 32.6%±1.63% by weight zinc;
approximately 0.6%±0.03% by weight silicon; and
approximately 64.7%±3.24% by weight copper;
approximately 0.9%±0.05% by weight indium;
wherein hardening agents consist of copper and indium.

* * * * *